US007576598B2

(12) United States Patent
Marinca

(10) Patent No.: US 7,576,598 B2
(45) Date of Patent: Aug. 18, 2009

(54) BANDGAP VOLTAGE REFERENCE AND METHOD FOR PROVIDING SAME

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 74 days.

(21) Appl. No.: 11/529,723

(22) Filed: Sep. 25, 2006

(65) Prior Publication Data

US 2008/0074172 A1 Mar. 27, 2008

(51) Int. Cl.
*G05F 1/567* (2006.01)

(52) U.S. Cl. ..... 327/539; 323/314

(58) Field of Classification Search ..... 327/539
See application file for complete search history.

(56) References Cited

U.S. PATENT DOCUMENTS

| | | | | |
|---|---|---|---|---|
| 4,399,398 | A | 8/1983 | Wittlinger | |
| 4,475,103 | A | 10/1984 | Brokaw et al. | |
| 4,603,291 | A | 7/1986 | Nelson | |
| 4,714,872 | A | 12/1987 | Traa | |
| 4,800,339 | A | 1/1989 | Tanimoto et al. | |
| 4,808,908 | A | 2/1989 | Lewis et al. | |
| 4,939,442 | A | 7/1990 | Carvajal et al. | |
| 5,053,640 | A | 10/1991 | Yum | |
| 5,119,015 | A | 6/1992 | Watanabe | |
| 5,229,711 | A * | 7/1993 | Inoue | 323/313 |
| 5,325,045 | A | 6/1994 | Sundby | |
| 5,352,973 | A | 10/1994 | Audy | |
| 5,371,032 | A | 12/1994 | Nishihara | |
| 5,424,628 | A | 6/1995 | Nguyen | |
| 5,512,817 | A | 4/1996 | Nagaraj | |
| 5,563,504 | A | 10/1996 | Gilbert et al. | |
| 5,646,518 | A | 7/1997 | Lakshmikumar et al. | |
| 5,821,807 | A | 10/1998 | Brooks | |
| 5,828,329 | A | 10/1998 | Burns | |
| 5,933,045 | A | 8/1999 | Audy et al. | |
| 5,952,873 | A | 9/1999 | Rincon-Mora | |
| 5,982,201 | A | 11/1999 | Brokaw et al. | |
| 6,002,293 | A | 12/1999 | Brokaw | |
| 6,075,354 | A | 6/2000 | Smith et al. | |

(Continued)

FOREIGN PATENT DOCUMENTS

| | | |
|---|---|---|
| EP | 0510530 | 10/1992 |

(Continued)

OTHER PUBLICATIONS

Banba et al, "A CMOS bandgap reference circuit with Sub-1-V operation", IEEE JSSC vol. 34, No. 5, May 1999, pp. 670-674.

(Continued)

*Primary Examiner*—Lincoln Donovan
*Assistant Examiner*—Terry L Englund
(74) *Attorney, Agent, or Firm*—Wolf, Greenfield & Sacks, P.C.

(57) ABSTRACT

A bandgap voltage reference circuit is provided that includes a PTAT source whose polarity reverses at a determinable temperature. The PTAT source is combined with a CTAT source in a manner to remove the effects of the slope of the CTAT source such that a voltage reference may be generated. A method of operating such a circuit is also described.

44 Claims, 6 Drawing Sheets

U.S. PATENT DOCUMENTS

| | | | | |
|---|---|---|---|---|
| 6,157,245 | A | 12/2000 | Rincon-Mora | |
| 6,218,822 | B1 | 4/2001 | MacQuigg | |
| 6,225,796 | B1 | 5/2001 | Nguyen | |
| 6,255,807 | B1 * | 7/2001 | Doorenbos et al. | 323/314 |
| 6,329,804 | B1 | 12/2001 | Mercer | |
| 6,329,868 | B1 | 12/2001 | Furman | |
| 6,356,161 | B1 | 3/2002 | Nolan et al. | |
| 6,362,612 | B1 | 3/2002 | Harris | |
| 6,373,330 | B1 | 4/2002 | Holloway | |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,549,072 | B1 | 4/2003 | Vernon | |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,801,095 | B2 | 10/2004 | Renninger, II | |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,919,753 | B2 | 7/2005 | Wang et al. | |
| 6,930,538 | B2 | 8/2005 | Chatal | |
| 6,958,643 | B2 | 10/2005 | Rosenthal | |
| 6,987,416 | B2 | 1/2006 | Ker et al. | |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,088,085 | B2 | 8/2006 | Marinca | |
| 7,091,761 | B2 | 8/2006 | Stark et al. | |
| 7,112,948 | B2 * | 9/2006 | Daly et al. | 323/316 |
| 7,170,336 | B2 * | 1/2007 | Hsu | 327/539 |
| 7,173,407 | B2 | 2/2007 | Marinca | |
| 7,193,454 | B1 | 3/2007 | Marinca | |
| 7,199,646 | B1 | 4/2007 | Zupcau et al. | |
| 7,211,993 | B2 | 5/2007 | Marinca | |
| 7,224,210 | B2 | 5/2007 | Garlapati et al. | |
| 7,236,047 | B2 * | 6/2007 | Tachibana et al. | 327/539 |
| 7,248,098 | B1 | 7/2007 | Teo | |
| 7,260,377 | B2 | 8/2007 | Burns et al. | |
| 7,301,321 | B1 * | 11/2007 | Uang et al. | 323/313 |
| 7,372,244 | B2 | 5/2008 | Marinca | |
| 7,411,380 | B2 | 8/2008 | Chang et al. | |
| 7,472,030 | B2 | 12/2008 | Scheuerlein | |
| 7,482,798 | B2 | 1/2009 | Han | |
| 2003/0234638 | A1 | 12/2003 | Eshraghi et al. | |
| 2005/0073290 | A1 | 4/2005 | Marinca et al. | |
| 2005/0194957 | A1 | 9/2005 | Brokaw | |
| 2005/0237045 | A1 | 10/2005 | Lee et al. | |
| 2006/0017457 | A1 | 1/2006 | Pan et al. | |
| 2006/0038608 | A1 | 2/2006 | Ozawa | |
| 2007/0176591 | A1 | 8/2007 | Kimura | |
| 2008/0018319 | A1 | 1/2008 | Chang et al. | |
| 2008/0074172 | A1 | 3/2008 | Marinca | |
| 2008/0224759 | A1 | 9/2008 | Marinca | |
| 2008/0265860 | A1 | 10/2008 | Dempsey et al. | |

FOREIGN PATENT DOCUMENTS

| | | | |
|---|---|---|---|
| EP | 1359490 | A2 | 11/2003 |
| EP | 1359490 | A3 | 11/2003 |
| JP | 4-167010 | | 6/1992 |
| KR | 0115143 | | 12/2007 |
| WO | WO 2004/07719 | | 2/2004 |

OTHER PUBLICATIONS

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

PCT/EP2008/058685 International Search Report and written opinion, Oct. 1, 2008.

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press-Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Jianping, Zeng, et al, "CMOS Digital Integrated temperature Sensor", IEEE, Aug. 2005, pp. 310-313.

PCT/EP2008/067402 International Search Report, Mar. 20, 2009.

PCT/EP2008/067403, International Search Report and Written Opinion, Apr. 27, 2009.

Pease, R.A., "The design of band-gap reference circuits: trials and tribulations", IEEE 1990 Bipolar circuits and Technology Meeting 9.3, Sep. 17, 1990, pp. 214-218.

* cited by examiner

Process independent sub-bandgap voltage reference

BANDGAP VOLTAGE REFERENCE AND METHOD FOR PROVIDING SAME

BACKGROUND OF THE INVENTION

The present invention relates to voltage references and in particular to voltage reference implemented using bandgap circuitry. The invention more particularly relates to a voltage reference circuit and a method which provides a reference voltage output that is independent of the process variations. Such a circuit is particularly advantageous in the provision of sub-bandgap voltage reference circuits.

BRIEF SUMMARY OF THE INVENTION

A typical bandgap voltage reference circuit is based on addition of two voltages having equal and opposite temperature coefficients.

FIG. 1 shows in schematic form an example of a known band gap voltage reference. It consists of a current source, I1, a resistor, r1, and a diode, d1. It will be understood that the operation of the diode is equivalent to that of a forward biased base-emitter voltage of a bipolar transistor. The voltage drop across the diode has a negative temperature coefficient, TC, of about −2.2 mV/C and is usually denoted as a Complementary to Absolute Temperature, or CTAT voltage, as its output value decreases with increasing temperature. The current source I1 is desirably a Proportional to Absolute Temperature, or a PTAT source, such that the voltage drop across r1 is PTAT voltage. In this way as absolute temperature increases, the voltage output will also increase. The PTAT current is generated by reflecting across a resistor a voltage difference ($\Delta V_{be}$) of two forward-biased base-emitter junctions of bipolar transistors operating at different current densities. Such operation is well known in the art.

FIG. 2 represents schematically the operation of the circuit of FIG. 1. By combining the CTAT voltage, V_CTAT, of d1 with the PTAT voltage, V_PTAT, resultant from the voltage drop across r1 it is possible to provide a relatively constant output voltage Vref over a wide temperature range—the two combine to provide a Vref which is substantially flat across temperature. However, in this arrangement there are two unknowns which must be combined in a prescribed configuration to provide the desired output. The first unknown is the CTAT voltage which is very strongly dependent on process parameters. The geometry of the corresponding junction and the difference in doping level have relatively large variations from lot to lot and die to die. These variations are reflected as changes in voltage drop across the diode both at 0K and at room temperature. Such variations can lead to inaccuracies in the resultant Vref. The voltage drop across the diode at 0K is called the bandgap voltage, denoted Eg0. If the PTAT and CTAT voltages are well matched, the value of the reference voltage will equal the band gap voltage, Eg0. While not affected in the same manner by process variations as the CTAT voltage is, the PTAT voltage is also affected by various errors of the circuit, especially by offset voltages of the transistors and mismatches of the resistors.

There are different approaches to trim a bandgap voltage reference. The first method is to trim the reference at a so called "magic" value. An example of how this trimming method is achieved is illustrated in FIG. 3. This example assumes that the second order error, sometimes called the "curvature" error, which is inherently present in bandgap voltage references, is removed such that the reference voltage variation vs. temperature is a straight line. If the PTAT and CTAT voltages are well balanced (denoted by PTAT_0, CTAT_0), the reference voltage, Vref_0, is equal to the diode's bandgap voltage, Eg_0, and it has zero temperature coefficient, TC. However, as mentioned above, due to the process variations used in the manufacturing process, the diode's bandgap voltage can change from Eg_0 to Eg_1 and the voltage drop across the diode changes from CTAT_0 to CTAT_1. If we assume that the PTAT voltage remains unchanged (PTAT_0=PTAT_1) the resulting voltage reference (Ref 1) at room temperature (T0) drops from Vref_0 and it also have a positive slope, i.e. the output is not constant across temperature. It will be understood that both changes are unwanted. To compensate for the drop in the value of the reference voltage Vref, the PTAT voltage can be trimmed at room temperature to provide the "magic" value for the reference voltage, Vref_0. To achieve this modification, the PTAT voltage is accordingly changed from PTAT_0 to PTAT_2, The resulting reference voltage (Ref_2) has the "magic" value only at room temperature but its TC is even worse. As a result it is evident that while this method can guarantee a nominal value at room temperature, it does not provide a satisfactory voltage reference as the temperature coefficient response is not good and the reference will therefore vary with varying temperatures.

An alternative technique is to utilise two trimming steps, at two different temperatures. At a first temperature, say room temperature, the reference voltage is measured. But because Eg_0 changes from die to die, this value is always different from desired value. At a second temperature, usually a higher temperature, the reference is trimmed to the same value as it was at first temperature. To overcome this situation a third trimming is required by gaining the resulting reference voltage to the desired value. As a result when a lot of prior art voltage references are trimmed at two different temperatures, an expensive tracking procedure is required to identify the part from the lot and its corresponding voltage value.

An example of a known more detailed CMOS bandgap voltage reference is presented on FIG. 4. Two parasitic substrate bipolar transistors, Q1 and Q2, are operating at different collector current density, usually by appropriate scaling of their emitter area. An amplifier A1 controls the common gate of three identical PMOS transistors, M1, M2 and M3 such that, from the supply line, three identical currents are forced and a voltage is generated at the Vref node. If the base current of the bipolar transistors (Q1, Q2) can be neglected and assuming an ideal amplifier A1, then the collector current density ratio is n and a base-emitter voltage difference is developed across r1:

$$\Delta Vbe = \frac{KT}{q}\ln(n) = \Delta V_{be0}\frac{T}{T_0} \tag{1}$$

Here

K is boltzman constant;

T is actual absolute temperature [K];

$T_0$ is the reference temperature, usually room temperature;

q is electronic charge;

$\Delta V_{be0}$ is the base-emitter voltage difference at room temperature.

This voltage has a typical slope between 0.2 mV/C to 0.4 mV/C and is usually amplified by a factor of 10 to 5 in order to balance the base-emitter voltage slope to generate the reference voltage as FIG. 2 and Eq. 2 shows:

$$V_{ref} = V_{be}(Q3) + \frac{r_2}{r_1}\frac{KT}{q}\ln(n) \quad (2)$$

The resistor ratio $r_2/r_1$ represents the gain factor for $\Delta V_{be}$.

Such circuits based on a CMOS process generate a voltage having significant variations from die to die mainly due to MOS transistor offset voltages. It is also a noisy reference voltage as MOS transistors generate large noise, especially low frequency noise, compared to a bipolar based bandgap voltage reference. The main offset and noise contributor of the circuit according to FIG. 4 is transistor M2 as its errors are directly reflected on r1 and are amplified from r1 to the reference voltage by the resistor ratio which is about 5 to 10.

Another drawback of a circuit in this configuration is its poor Power Supply Rejection Ratio i.e. its ability to reject variation in the supply voltage.

A typical value of a bandgap voltage reference is about 1.25V. There is more demand for lower voltage references, such as 1V or 1.024V. These reference voltages are called "sub-bandgap" voltage references, as their value is less than a normally generated bandgap voltage reference.

One sub-bandgap voltage is described in "A CMOS Bandgap Reference Circuit with Sub-1-V Operation", Banba et al. JSSC Vol. 34, No. 5, May 1999, pp 670-674. This circuit can be derived from that of FIG. 4 by adding two resistors from the two amplifier's inputs to ground. As these two resistors are connected in parallel to a base-emitter voltage, a corresponding CTAT current is forced in each PMOS transistor connected at two inputs of the amplifier (M1 and M2 in FIG. 4). When the CTAT currents are balancing corresponding PTAT currents generated by the ΔVbe voltage, all PMOS mirrors will force constant currents including M3 which will force a constant voltage across a load resistor generating at the output node a temperature insensitive or reference voltage.

Although this teaches the provision of a sub-bandgap reference it suffers in that the reference voltage is not corrected for the "curvature" error, which as was mentioned above is inherently present in such circuits due to second order effects. As a result it cannot be trimmed for a temperature coefficient of less than 15 ppm due to this curvature error. A modified version of this sub-bandgap voltage reference is presented on "Curvature Compensated BiCMOS Bandgap with 1V Supply Voltage", Malcovati et al., JSSC, Vol. 36, No. 7, July 2001.

Sub-bandgap voltage references such as those described in this publication are commonly denoted as "current mode" and are dependent on MOS transistors behaviour as the two components, PTAT and CTAT currents are separately generated and combined to generate the reference voltage across a resistor.

There are variants of "voltage mode" sub-bandgap voltage references based on adding fractions of base-emitter voltage to a corresponding PTAT component to generate temperature insensitive reference voltages. A sub-bandgap voltage reference is described in: "A low noise sub-bandgap voltage reference", Sudha, M.; Holman, W. T.; Proceedings of the 40th Midwest Symposium on Circuits and Systems, 1997. Volume 1, 3-6 Aug. 1997 Page(s):193-196. This reference circuit generates a low reference voltage as a base-emitter voltage difference of two bipolar transistors operating at different current density. The base-emitter difference is subtracted via a resistor divider. As it stands this circuit cannot be implemented in a low cost CMOS process. In order to use the reference voltage this circuit has to be followed by a gain stage. Because the reference voltage value is about 200 mV usually it needs to be amplified to 1V or more. By amplifying the reference voltage the errors of both the reference circuit and the amplifier will increase in proportion to the gain factor. This is not ideal.

A curvature-corrected sub-bandgap voltage which can be implemented on a CMOS process is described in U.S. Pat. No. 7,253,597 to Paul Brokaw, co-assigned to the assignee of the present invention. This circuit based on a combination of two bipolar transistors, four resistors, an amplifier and three PMOS transistors and generates a constant current and a temperature independent voltage across a load resistor. As with other MOS variants this reference is also very much affected by offset and noise of MOS transistors.

A CMOS bandgap voltage reference was disclosed in "A method and a circuit for producing a PTAT voltage and a method and a circuit for producing a bandgap voltage reference" U.S. Pat. No. 7,193,454, co-assigned to the assignee of the present invention. In order to reduce offset and noise sensitivity due to MOS current mirrors, this circuit is based on a combination of two amplifiers, the first generating an inverse PTAT voltage and the second generating a reference voltage by mixing a base-emitter voltage of a bipolar transistor and the output voltage of the first amplifier. This circuit offers a low offset voltage and does not suffer from noise sensitivity arising from MOS current mirrors but suffers in that these benefits are achieved by increasing the circuit complexity.

Due to these and other disadvantages associated with the prior art there is a requirement for a bandgap voltage reference that may be implemented using a single amplifier.

These and other problems associated with the prior art are addressed by a bandgap voltage reference in accordance with the teachings of the invention. Such a circuit is based on the generation of a PTAT component which can be used to eliminate the slope of the CTAT component yet does not contribute to the absolute value of the resultant reference output.

A circuit in accordance with the teaching of the invention provides a first set of circuit elements whose output below a first temperature is a PTAT output of a first polarity and above that first temperature is a PTAT output of a second polarity. By judiciously selecting the temperature at which the PTAT output changes polarity the contribution of the PTAT output to the overall value of the reference can be minimized.

These and other features of the invention will be understood with reference to the exemplary embodiments which follow.

BRIEF DESCRIPTION OF THE DRAWINGS

The present invention will now be described with reference to the accompanying drawings in which.

DETAILED DESCRIPTION OF THE DRAWINGS

The prior art has been described with reference to FIGS. 1, 2, 3 and 4. Exemplary and non-limiting embodiments of implementations of the invention will now be described with reference to FIGS. 5 to 12.

The present invention addresses the problem of the prior art arrangements by reducing the number of unknown variables in the circuit in order to provide a more accurate voltage reference which is not dependant on process variations.

Figure 1:
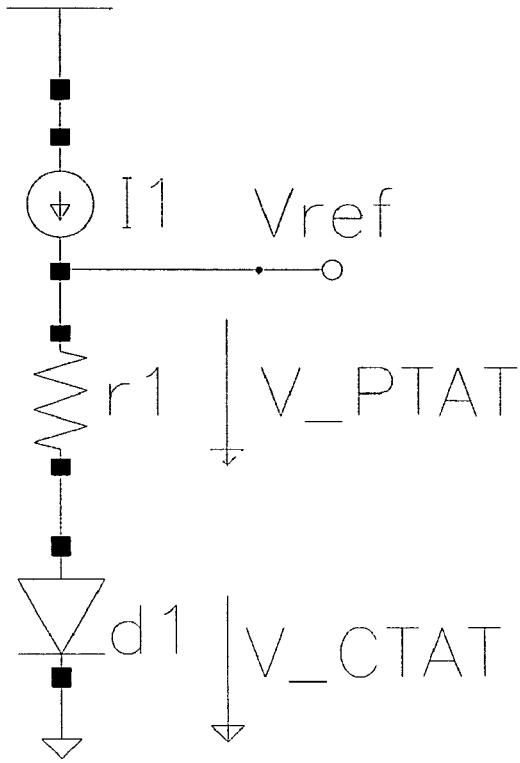
Fig.1 PRIOR ART
FIG. 1 is a schematic showing a known bandgap voltage reference circuit.
Figure 2:
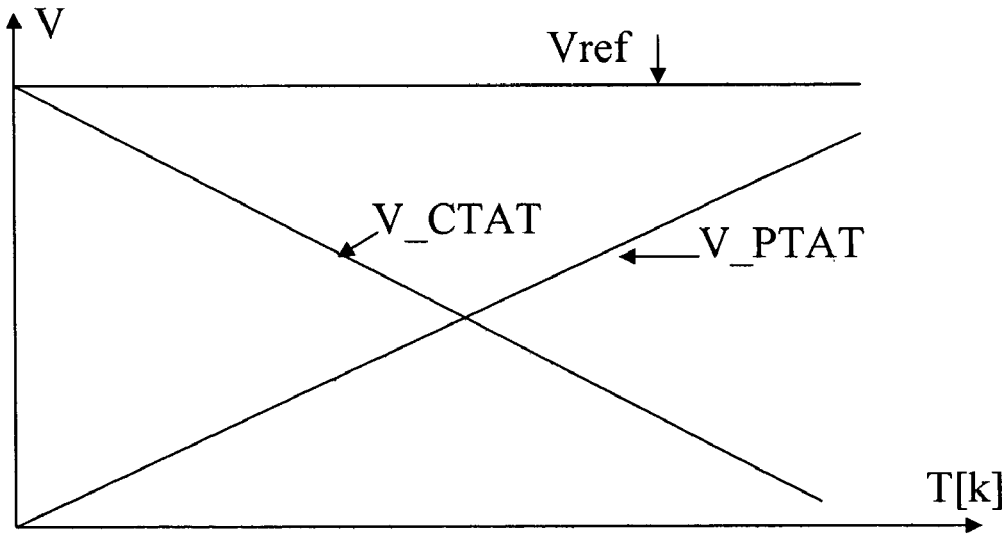
Fig.2 PRIOR ART
FIG. 2 shows graphically how PTAT and CTAT voltages generated through the circuit of FIG. 1 may be combined to provide a reference voltage.
Figure 3:
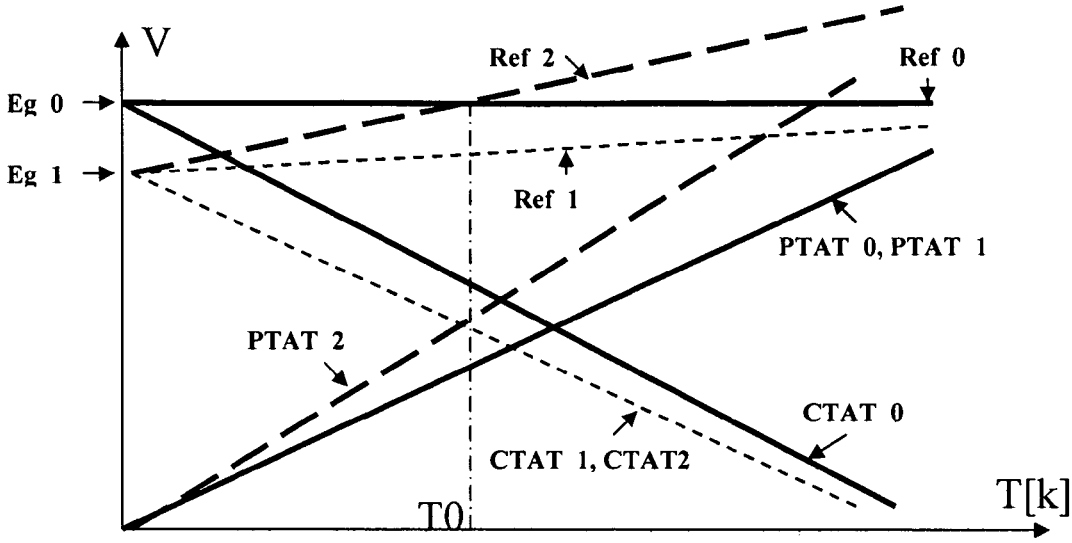
Fig.3 PRIOR ART
FIG. 3 illustrates how a typically bandgap voltage reference is trimmed for a "magic" voltage at one temperature.
Figure 5:
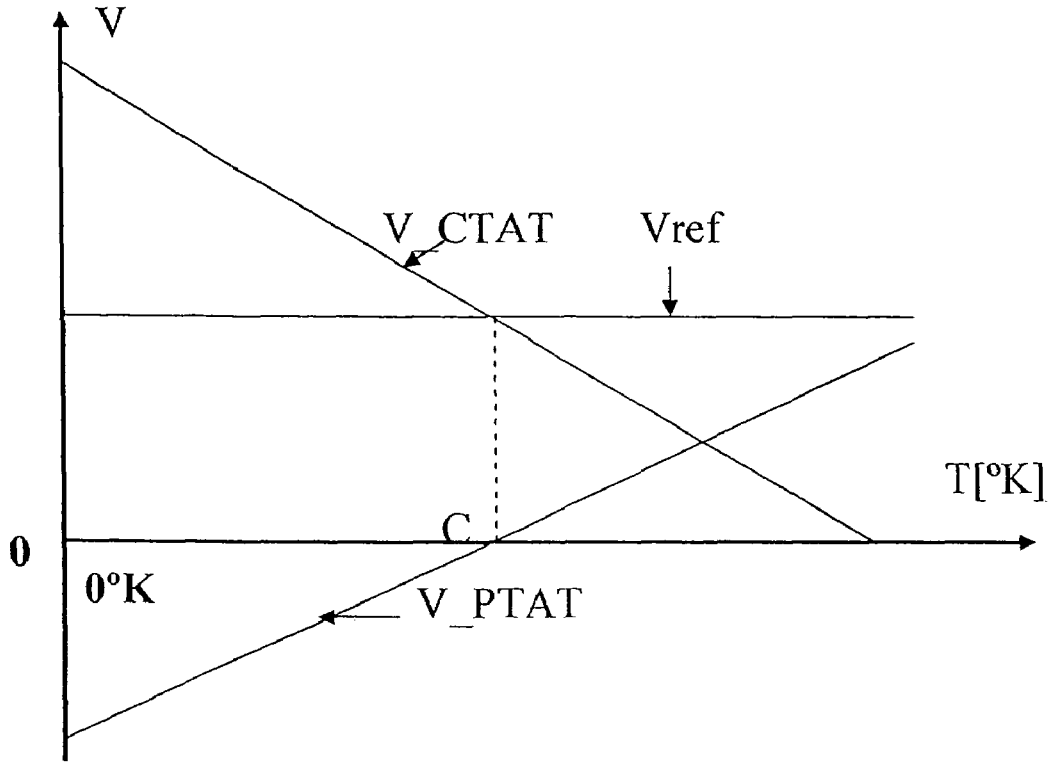
FIG. 5 shows graphically how a circuit in accordance with the teaching of the invention may be used to combine a shifted PTAT voltage and a CTAT voltage to provide a reference voltage.

FIG. 5 provides a graphic representation of how circuit components or elements of a circuit in accordance with the teaching of the invention may be combined to provide a reference voltage. The invention provides for the compensation of the slope contributed by the V_CTAT component by removing that slope as opposed to the prior art arrangement where it was compensated by addition of a corresponding PTAT voltage. The teaching of the invention provides for the generation of a shifted PTAT voltage, V_PTAT, which is negative below a first temperature, typically room temperature, and positive above that temperature. By the phrase "shifted" it will be understood that the polarity of the output changes as one passes through a selected temperature value. In this way if one examines the PTAT voltage of FIG. 5, it will be observed that the PTAT voltage has been shifted downward on the Y axis as compared to that of FIG. 2, a portion of the voltage output has a negative polarity whereas the rest has a positive polarity. In FIG. 2, all the output had a positive polarity. The cross over point chosen which may be preselected by the user, point C, can be used to determine the value of the resultant voltage reference, Vref. The cancelling of the effect of one of the two unknown parameters from the prior art arrangements and then the adjustment of that unknown to a precise value enables the provision of an accurate sub-bandgap voltage reference.

It will be understood from an examination of FIG. 5 that the PTAT voltage generated has a polarity at absolute zero that is opposite that of the corresponding CTAT voltage. In known architectures, the PTAT and CTAT voltages have the same polarity (a positive polarity), just different slopes. The present invention provides for a generation of a PTAT voltage that has a first polarity at a first temperature and the opposite polarity at a second temperature, the second temperature being greater than the first temperature. In this way, the PTAT voltage generated undergoes a transition or crossover where its polarity will change. The point of this crossover is used, in accordance with the teaching of the invention to affect the absolute value of the reference voltage generated. It will be understood that if there is no crossover, i.e. that a PTAT voltage is provided with a polarity always opposite to that of the CTAT voltage with which it is combined that the reference output will be zero.

It will be further understood that the point of crossover of the PTAT is used to select the absolute value of the CTAT voltage that will form the basis of the reference output. Unless the crossover point is absolute zero, this CTAT value will be less than a bandgap voltage. Unless this value is then amplified or scaled in some other fashion the resultant reference voltage will be a value less than a bandgap voltage, i.e. a sub-bandgap voltage reference.

Figure 6:
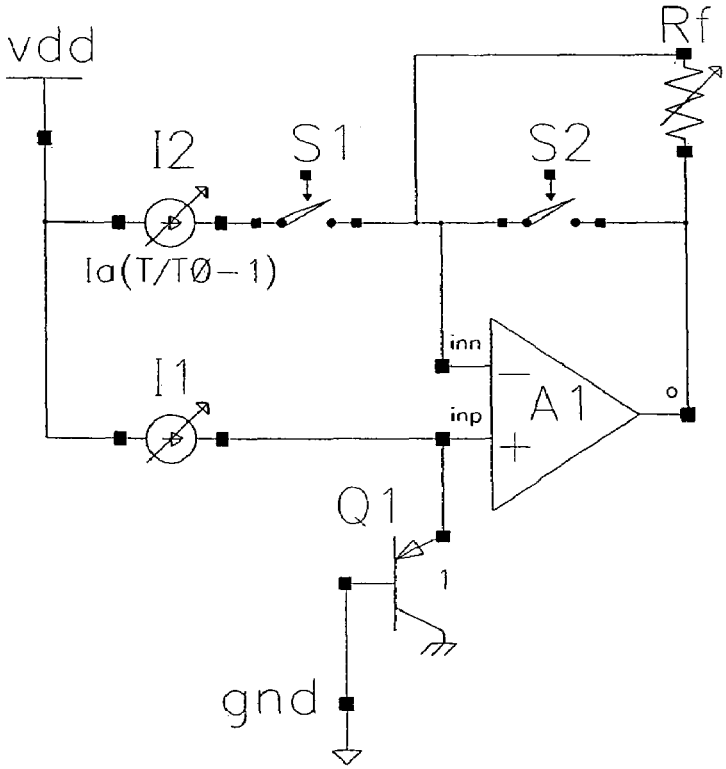
FIG. 6 shows an implementation of a bandgap voltage reference circuit in accordance with the teaching of the invention.

FIG. 6 shows in an exemplary fashion how such a combination of PTAT and CTAT voltages may be realised. It will be appreciated that this is provided as a generic implementation of a sub-bandgap voltage reference, in accordance with the teaching of the invention but it is not intended to limit the invention to such an arrangement. This circuit includes a substrate forward biased bipolar transistor Q1 whose base-emitter voltage is a CTAT voltage, two current sources, I1, I2, an amplifier, A1, a resistor Rf, and two switches, S1, S2. The current I1 is typically a PTAT current. The current I2 is a shifted PTAT current such that its output is zero at a preselected temperature value, which will typically be the reference (or room) temperature, $T_0$. In normal operation S1 is closed and S2 is open. As a result, assuming that the amplifier has no offset voltage, the amplifier's output voltage will be the voltage drop of Q1 plus the feedback voltage drop across Rf due to the input current I2. For a given I2 current there is only one value of Rf for which the temperature slope of Q1 is completely compensated by the shifted voltage drop across Rf and the amplifier's output voltage is temperature insensitive. This voltage is the voltage drop of Q1 at temperature T0 as the feedback current is zero at T0. At temperature T0 the reference is trimmed in two steps.

1) First, for S1 open and S2 closed the output voltage of the amplifier is measured. The corresponding voltage will be the reference voltage. If this value is different from the desired value the current I1 is to be adjusted accordingly.

2) Second, S1 is closed and S2 is open and I2 is trimmed to zero such that the reference voltage value remains the desired value. At this stage the reference is trimmed only for absolute value. For temperature coefficient (TC) with S1 closed and S2 is open, the reference voltage is trimmed at a different temperature, usually higher by trimming Rf until the reference voltage remains the desired voltage. As the reference voltage variation vs. temperature is a straight line with two equal values at different temperatures the reference is temperature insensitive.

A very important feature of this reference circuit is that it is no longer dependent on the process used to fabricate the components of the circuit. The desired output value is under control as compared to the typical bandgap voltage reference, described previously with reference to the Background, which is based on summation of two voltages with opposite TC where the "magic" voltage is out of control.

It will be appreciated that the teaching of the invention overcomes the problem of the two unknown parameters which was present in the prior art arrangement by forcing $V_{be}$ of the diode to a desired value that is process independent and then using that value as the determining value for the remainder of the calibration steps. The desired voltage reference can either be a base-emitter voltage, a gained replica or an attenuated replica of this voltage.

It will be understood that the circuit and methodology rely on the provision of a shifted PTAT voltage or current. There are different arrangements or configurations that could be used to generate a shifted PTAT current through the feedback resistor of FIG. 6. While any one of these arrangements could be implemented within the context of the invention, it is always preferred to generate this current without using current mirrors as such mirrors may introduce errors in the output.

Figure 7:
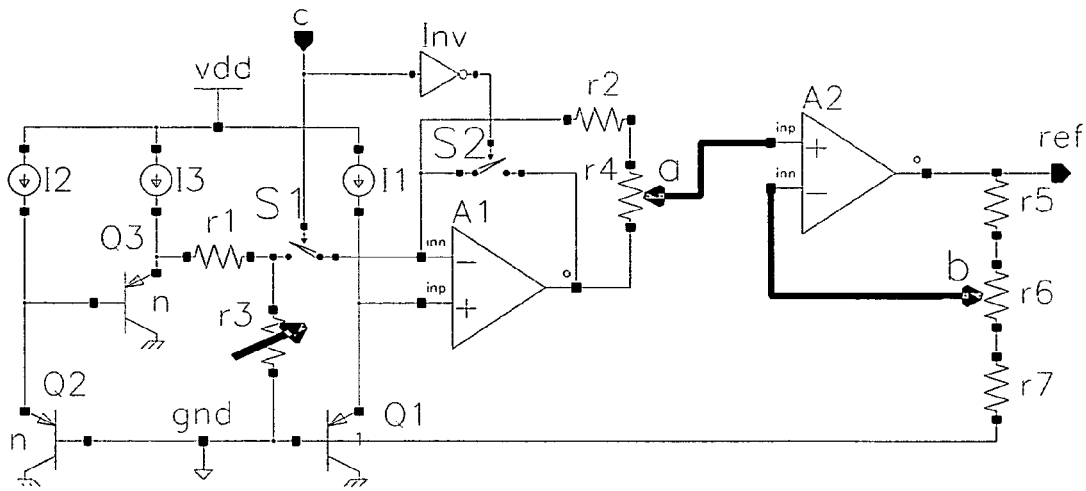
FIG. 7 shows another implementation of the circuit according to FIG. 6, which is configured to provide a buffered output.

FIG. 7 shows an arrangement based on that presented in FIG. 6 which provides a sub-bandgap voltage reference at a node "a" and a desired or buffered reference voltage at a node "ref" neither of which are sensitive to process variations. It can be considered as being formed from a first and second set of circuit elements. The first set of elements provide the sub-bandgap voltage reference basic circuit and consists of three bipolar transistors, Q1, Q2 and Q3; two fixed value resistors, r1, r2; two variable resistors, r3, r4; an operational amplifier A1, three current sources, I1, I2 and I3, two analog switches, S1, S2 and a logic inverter, Inv. Preferably Q1 is a unity emitter substrate bipolar transistor, Q2 and Q3 are each an area of n parallel unity emitter substrate bipolar transistors; I1 and I2 are PTAT (proportional to absolute temperature) currents and I3 is preferably a CTAT (complementary to absolute temperature) current. By providing a bipolar transistor at the non-inverting input and a stack of two bipolar transistors via a resistor, r1, at the inverting input of the amplifier, the feedback current resultant is a difference of two currents, one CTAT and one PTAT. The resistor r3 has the role of forcing the feedback current to zero at a specific temperature. In this way the current of the form $T/T_0-1$ which was shown in FIG. 5 is being generated through the feedback resistor Rf. A current of this form has an output whose relationship with temperature is defined by $T/T_0-1$. By trimming R3 it is possible to adjust the crossover point where the feedback current will changes it polarity. The variable resistor r4 can be trimmed to adjust the temperature coefficient (TC) response of the circuit.

As the voltage at the node "a" is related to the base emitter voltage of transistor Q1, it will be understood that the presence of a single resistor Q1 at the non-inverting node results in a sub-bandgap voltage being generated at this node.

The second set of circuit elements which provide the remainder of the circuit, are designed to generate a desired or buffered reference voltage from the output of the first set of circuit elements taken from node "a". This buffered output at a node "ref" is generated by circuit components including an amplifier A2 and three resistors, r5, r6, r7, where r5 and r7 are fixed resistors and r6 is a variable resistor, all provided in a negative feedback configuration coupled to the inverting node of amplifier A2. The node "a" is coupled to the non-inverting node. A logic signal C will allow for the operation of the circuit in "test" mode, for C=1, when S1 is open and S2 is closed and in "normal" mode, for C=0, when S1 is closed and S2 is open. It will be understood that the trimming of resistor r6 may be used to scale the amplification of the output of the first set of circuit elements but that alternatively the emitter of Q1 could be forced to a desired value by replacing current source I1 with a variable current source—similar to what was shown in FIG. 6.

Examples of the types of circuitry that may be used to provide the PTAT and CTAT current generators are well known to those skilled in the art.

The sub-bandgap voltage reference output is a combination of the base-emitter voltage of Q1, plus the voltage drop across the feedback resistors from the inverting node of A1 to the tapping node, "a".

The base-emitter voltage of a bipolar transistor has a temperature variation according to (3):

$$V_{be} = V_{G0}\left(1 - \frac{T}{T_0}\right) + V_{be0}\frac{T}{T_0} - \sigma\frac{kT}{q}\ln\left(\frac{T}{T_0}\right) + \frac{kT}{q}\ln\left(\frac{I_c}{I_{c0}}\right) \tag{3}$$

Here $V_{G0}$ is base-emitter voltage at 0K, which is of the order of 1.2V; $V_{be0}$ is base-emitter voltage at room temperature; $\sigma$ is the saturation current temperature exponent; $I_c$ is the collector current at temperature T and $I_{c0}$ is the same current at a reference temperature $T_0$. The first two terms in (3) show a linear drop in temperature and the last two a nonlinear variation which is usually called "curvature" voltage. The two curvature terms can be combined in a single one, depending on the temperature variation of the collector current.

Assuming that the collector currents of Q1 and Q2 are PTAT currents of the same value and collector current of Q3 is a CTAT current having at room temperature ($T_0$) the same value as Q1 and Q2 then the base-emitter voltages for the three bipolar transistors are:

$$V_{be}(Q1) = V_{G0}\left(1 - \frac{T}{T_0}\right) + V_{be10}\frac{T}{T_0} - (\sigma - 1)\frac{kT}{q}\ln\left(\frac{T}{T_0}\right) \tag{4}$$

$$V_{be}(Q2) = V_{G0}\left(1 - \frac{T}{T_0}\right) + V_{be20}\frac{T}{T_0} - (\sigma - 1)\frac{kT}{q}\ln\left(\frac{T}{T_0}\right) \tag{5}$$

$$V_{be}(Q3) = V_{G0}\left(1 - \frac{T}{T_0}\right) + V_{be30}\frac{T}{T_0} - (\sigma + c)\frac{kT}{q}\ln\left(\frac{T}{T_0}\right) \tag{6}$$

Here $V_{be10}$, $V_{be20}$, $V_{be30}$, are the corresponding base-emitter voltage at reference or room temperature, $T_0$, and c is an approximation coefficient equal to zero for constant current, −1, for PTAT current as (4) and (5) show, and about 0.8 for CTAT current.

As Q2 and Q3 have n times larger emitter area compared to Q1 at $T_0$, the base-emitter voltage differences are:

$$\begin{aligned} V_{be10} - V_{be20} &= V_{be10} - V_{be30} \\ &= \frac{kT_0}{q}\ln(n) \\ &= \Delta V_{be0} \end{aligned} \tag{7}$$

At temperature T0 the feedback current is forced to zero by trimming r3. As a result the voltage at the sub-bandgap voltage reference is $V_{be10}$. This condition sets up the ratio of $r_3$ to $r_1$ as equation (8) shows:

$$\frac{r_3}{r_1} = \frac{V_{be10}}{V_{be10} - 2\Delta V_{be0}} \tag{8}$$

The sub-bandgap voltage reference is:

$$V_{ref} = A * V_{G0} - B * \frac{T}{T_0} - D * \frac{KT}{q}\ln\left(\frac{T}{T_0}\right) \tag{9}$$

Where A is the bandgap voltage multiplication coefficient, B is temperature linear coefficient and D is "curvature" coefficient. These coefficients are:

$$A = 1 + \frac{r_2}{r_3} - \frac{r_2}{r_1} \tag{10}$$

$$B = (V_{G0} - V_{be10})\left(1 + \frac{r_2}{r_3} - \frac{r_2}{r_1}\right) - 2\Delta V_{be0}\frac{r_2}{r_1} \tag{11}$$

$$D = (\sigma - 1) * \left(1 + \frac{r_2}{r_3}\right) - (\sigma + c) * \frac{r_2}{r_1} \tag{12}$$

In order to force a reference voltage temperature insensitive, B has to be set to zero. From (8) and (11) for B=0 we get:

$$\frac{r_2}{r_1} = \frac{V_{be10} * (V_{G0} - V_{be10})}{2\Delta V_{be0} * V_{G0}} \tag{13}$$

The ratio of $r_2$ to $r_3$ can be found from (8) and (13):

$$\frac{r_2}{r_3} = \frac{(V_{be10} - 2\Delta V_{be0}) * (V_{G0} - V_{be10})}{2\Delta Vbe0 * V_{G0}} \tag{14}$$

For a submicron CMOS process $V_{g0}$ is about 1.205V; the base-emitter voltage of a forward biased bipolar transistor at room temperature is about $V_{be10}$=0.7V; a typical $\Delta V_{be0}$ voltage at room temperature is about 0.1V; typical value for σ is 3.8.

For these values the resistor's ratios are:

$$\frac{r_2}{r_1} = 1.47;\ \frac{r_3}{r_1} = 1.4;\ \frac{r_2}{r_3} = 1.048; \tag{15}$$

Also the coefficient "c" for D=0, (12), is c=0.9, which indicates the right choice for biasing Q3 with CTAT current in order to compensate for "curvature" error. In this way it will be understood that the voltage output includes an inherent curvature correction element.

While implementations have been described heretofore with reference to the generation of sub-bandgap voltage references it will be understood that the teaching of the invention can be also used for bandgap references where it is desired to provide an output which is based on the combination of known parameters.

Figure 8:
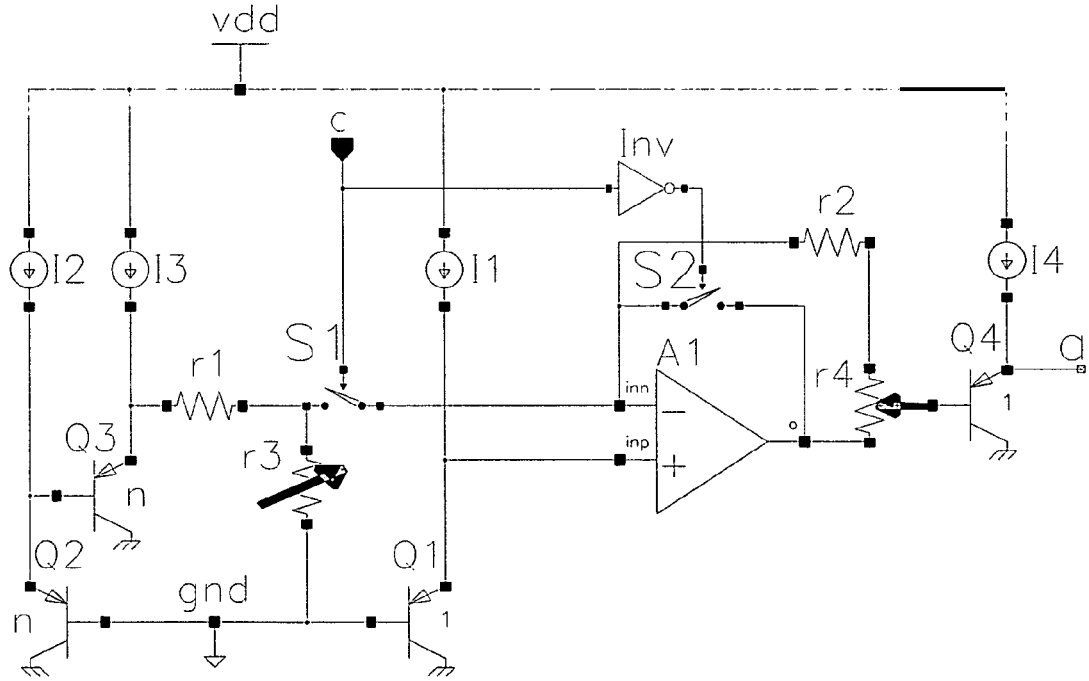
FIG. 8 shows how the circuit of FIG. 7 could be modified to generate an output having a value greater than 1 bandgap voltage.

Such an arrangement is shown in FIG. 8, which is a modification of the arrangement of FIG. 7. In this arrangement a further base emitter voltage is generated at the output of amplifier A1, by coupling a bipolar transistor Q4 to resistor r4. By coupling the base of Q4 to the resistor r4 and changing accordingly the feedback resistor Rf, and the tapping node "a" to the emitter node of the transistor it is possible to provide at that node a voltage whose output is twice a Vbe.

Figure 9:
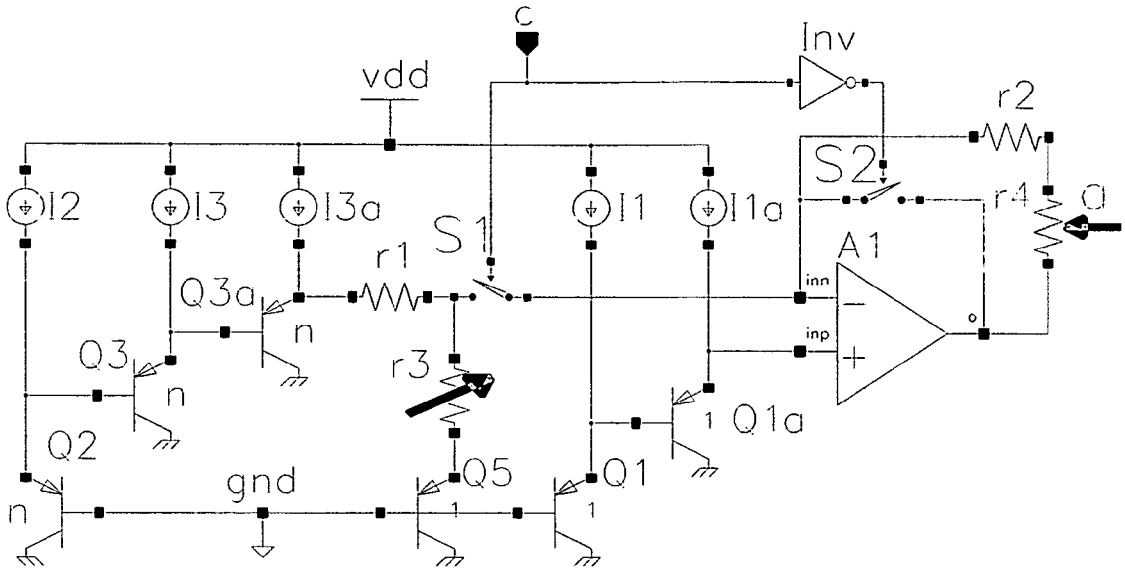
FIG. 9 shows an alternative circuit to FIG. 8.

Another way to generate the multiple bandgap voltage at node "a" is shown In FIG. 9. In this configuration, transistors Q1 and Q3 are provided as a stack arrangements (Q1, Q1*a*, Q3, Q3*a*, where Q1*a* and Q3*a* represents a single or multiple transistors) coupled to the non-inverting node of amplifier A1. By providing a stack arrangement, the $V_{be}$ generated is a multiple of a single $V_{be}$, which means that the resultant output at node "a" can be generated as a multiple sub-bandgap voltage. Here Q5 is compensating the stacked Q1 a such that across R3 only one base-emitter voltage is reflected and R3 remains reasonable low. This arrangement has the advantage that the power supply rejection ratio is less than prior art arrangements and also is generated using less unknown parameters.

The circuit of FIG. 9 needs a larger supply voltage compared to the circuits of FIG. 7 and FIG. 8 but is less sensitive to the amplifier's offset voltage as a larger ΔVbe is generated from two base-emitter voltages of high current density to the corresponding three base-emitter voltages of low current density.

Figure 10:
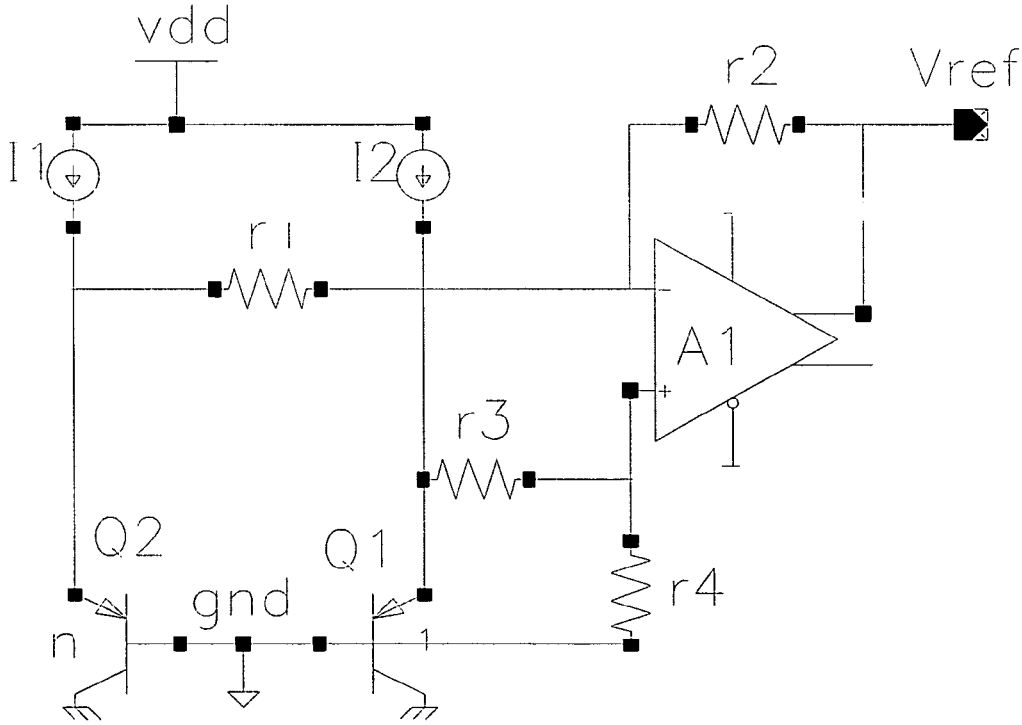
FIG. 10 shows a modification to the circuit of FIG. 7 for operation at very low supply voltage.

FIG. 10 shows a sub-bandgap voltage reference able to operate at very low supply voltage. Here the non-inverting input of the amplifier A1 is connected to a fraction of the base-emitter voltage of the Q1 which is the high current density bipolar transistor. The non-inverting input of the amplifier A1 is connected via r1 to the emitter of Q2 operating at low current density. FIG. 10 may be used to provide more flexibility than that available using the configurations of FIG. 6 or FIG. 7 as the non-inverting input of the amplifier can be set to any value less than a base-emitter voltage. If r3=r4 then the voltage contributed from Q1 is half that of FIG. 6 and the reference voltage will be scaled down accordingly.

Figure 11:
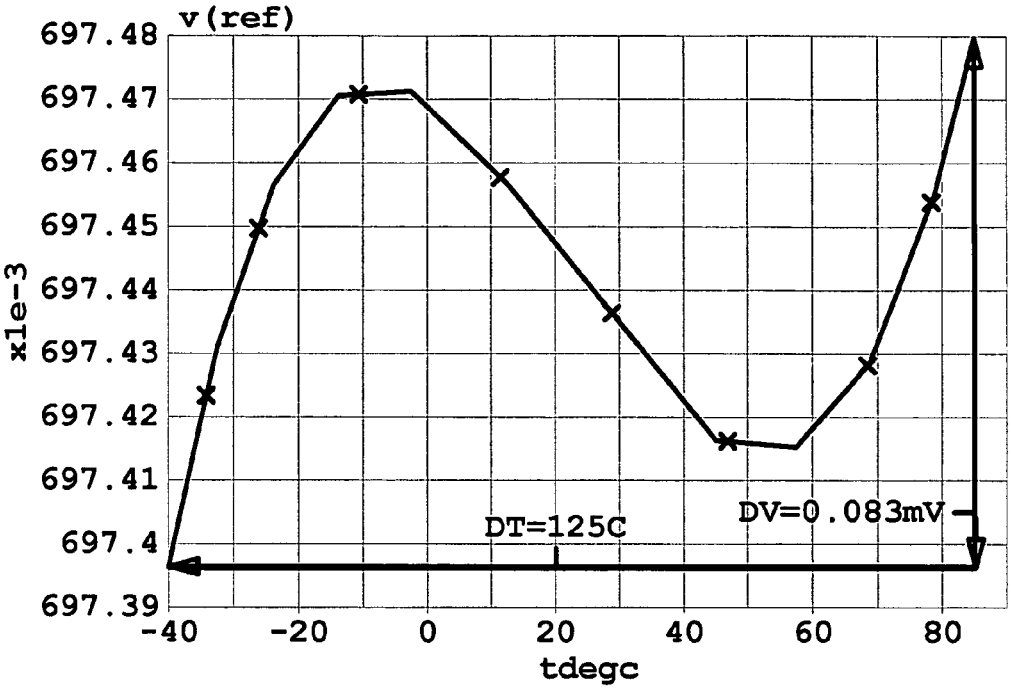
FIG. 11 shows simulated results for the performance of a circuit implemented according to the example of FIG. 7.

FIG. 11 shows results for a simulated sub-bandgap voltage reference according to the circuit of FIG. 7 for: unity emitter substrate bipolar Q1 biased with PTAT current of 8 uA at room temperature, Q2 with an emitter area of 31 compared to Q1 and biased with PTAT current of 3 uA at room temperature, Q3 with an emitter area of 31 compared to Q1 and biased with CTAT current of 4.2 uA at room temperature.

As the simulation shows the reference voltage has a variation of about 83 uV for the industrial temperature range (−40 C to 85 c) which corresponds to a temperature coefficient (TC) of less than 1 ppm/C degree.

As will be apparent to those skilled in the art, a buffered reference voltage with a desired value will be provided at the "ref" node by trimming r6 so as to achieve the desired value, or as mentioned above by forcing the emitter of Q1 to a desired value.

Figure 12:
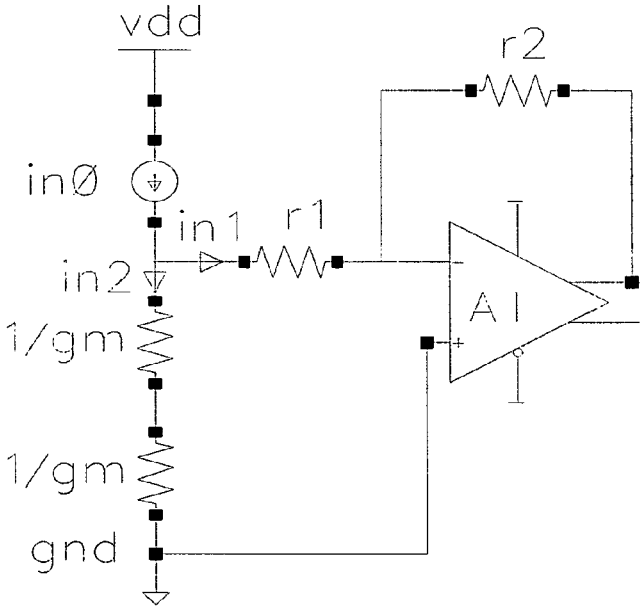
FIG. 12 is an equivalent circuit of FIG. 7 for the purpose of calculation the noise and supply voltage sensitivity.

FIG. 12 is a model schematic for the sub-bandgap voltage reference circuit of FIG. 7 (with r3 omitted) for the purpose of demonstrating how the sub-bandgap voltage reference circuit in accordance with the teaching of the invention reacts to offset voltage and noise injected from PMOS mirrors. As was evident from an examination of FIG. 7, the current sources I2 and I3 are coupled to Vdd and hence could be affected by noise on that line. The simplified arrangement presented in FIG. 12 is useable to ascertain the effect of that noise. In this schematic, in0 is a current source corresponding to the offset or noise current of I3 injected through a PMOS mirror; r1 and r2 are the same resistors as in FIG. 7; Q2 and Q3 from FIG. 7 are replaced by their resistors, 1/gm.

As the impedance through the two 1/gm resistors is less than that through r1, the noise current, in0, is mainly dumped to ground via the two 1/gm resistors in series with a corresponding value of more than ten times r1. Assuming at room temperature the currents through r1 and Q2 and Q3 having the same value then the ratio of the current injected into the amplifier's non-inverting node, in1, to the total noise current in0 is:

$$\frac{in_1}{in_0} = \frac{\frac{2}{g_m}}{\frac{2}{g_m} + r1} \tag{16}$$

-continued $$= \frac{2 * Vt_0}{2 * Vt_0 + V_{be0} - 2 * \Delta V_{be0}}$$

$$= \frac{2 * 0.026}{2 * 0.026 + 0.7 - 2 * 0.1}$$

$$= 0.094$$

Here $Vt_0$ is $kT_0/q$, or thermal voltage, of 26 mV at T=300K. As Equation (16) shows more than 90% of the noise injected from PMOS mirrors is dumped to ground through Q2 and Q3 and less than 10% is diverted to the amplifier's inverting node such that the reference voltage is desensitized to the supply voltage variation and current mirrors mismatches and noise.

Figure 4:
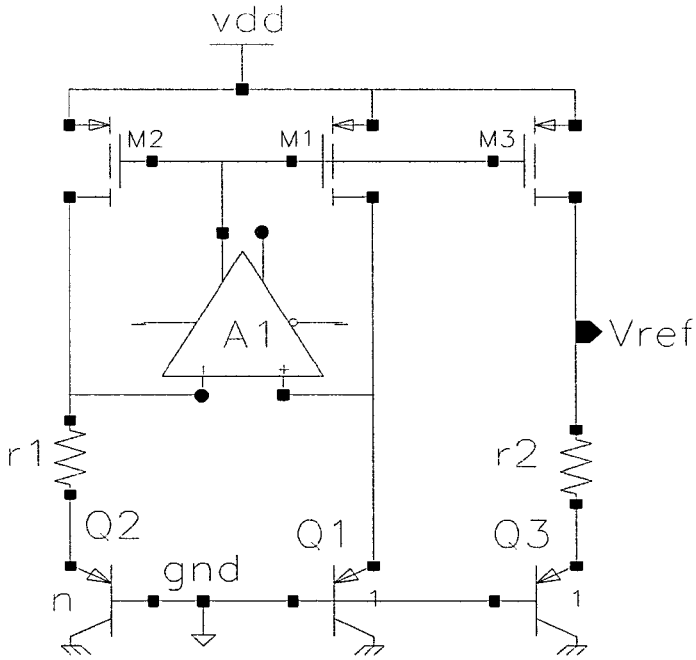
Fig.4 PRIOR ART
FIG. 4 is an example of a known CMOS circuit for providing a bandgap voltage reference.

The advantages of the bandgap voltage references according to FIG. 4, FIG. 6 and FIG. 10 compared to typical CMOS bandgap voltage reference are numerous and include:

easy to trim for a desired value;

low noise;

tight distribution due to process variation;

high PSRR;

inherent curvature-correction;

low voltage operation.

It will be understood that what has been described herein is a circuit and methodology that provides a voltage reference whose output is independent of process variations. By providing circuitry that generates a PTAT voltage whose output at a preselected temperature can be chosen to be zero it is possible to reduce the number of unknown parameters that are used in generation of bandgap voltage references.

A bandgap voltage reference circuit according to the teaching of the invention includes a PTAT source whose polarity reverses at a determinable temperature. The PTAT source is combined with a CTAT source in a manner to remove the effects of the slope of the CTAT source such that a voltage reference may be generated.

It will be appreciated that another advantage provided by the methodology of the present invention arises from the fact that according to the teaching of the present invention, the reference voltage target is always the desired value at any trimming step as compared to the prior art arrangements where the voltage is changed from one step to another because TC and absolute value interact.

While the invention has been described with reference to specific exemplary embodiments it will be understood that these are provided for an understanding of the teaching of the invention and it is not intended to limit the invention in any way except as may be deemed necessary in the light of the appended claims. In this way modifications can be made to each of the Figures, and components described with reference to one embodiment can be interchanged with those of another without departing from the spirit and/or scope of the invention.

The words comprises/comprising when used in this specification are to specify the presence of stated features, integers, steps or components but does not preclude the presence or addition of one or more other features, integers, steps, components or groups thereof.

What is claimed as new and desired to be protected by Letters Patent of the United States is:

1. A bandgap voltage reference circuit configured to provide a voltage reference at an output thereof, the circuit including:

a first set of circuit elements, the first set of circuit elements arranged to provide a complementary to absolute temperature (CTAT) voltage or current;

a second set of circuit elements, the second set of circuit elements arranged to provide a proportional to absolute temperature (PTAT) voltage or current, such that at absolute zero temperature its polarity (relative to zero) is opposite to that of the complementary to absolute temperature voltage or current produced by the first set of circuit elements; and a third set of circuit elements, the third set of circuit elements being arranged to combine the CTAT voltage or current with the PTAT voltage or current so as to generate the voltage reference.

2. The circuit as claimed in claim 1 wherein the output of the first set of circuit elements is a first polarity (relative to zero) and the output of the second set of circuit elements is a second polarity (relative to zero) below a first temperature and the first polarity above that first temperature.

3. The circuit as claimed in claim 1 wherein the second set of circuit elements are arranged to provide the PTAT current or voltage whose polarity reverses above an identifiable temperature.

4. The circuit as claimed in claim 3 where above the identifiable temperature the polarity of the PTAT current or voltage provided by the second set of circuit elements is positive (relative to zero).

5. The circuit as claimed in claim 3 wherein the identifiable temperature represents a crossover point wherein the polarity of the PTAT current or voltage changes relative to zero.

6. The circuit of claim 5 wherein the voltage reference value is related to the crossover point.

7. The circuit of claim 6 wherein the voltage reference value is related to the value of the CTAT voltage or current at the crossover point.

8. The circuit of claim 7 wherein the voltage reference value is the value of the CTAT voltage at that crossover point.

9. The circuit of claim 8 wherein the voltage reference is a multiple of the CTAT voltage or current at that crossover point.

10. The circuit of claim 5 wherein the identifiable temperature chosen for the crossover point is room temperature.

11. The circuit of claim 1 wherein the generated voltage reference is a sub-bandgap voltage reference.

12. The circuit of claim 1 wherein the second set of circuit elements includes a current source.

13. The circuit of claim 12 wherein the current source is coupled to an inverting input node of an amplifier.

14. The circuit of claim 13 wherein the amplifier includes a resistor provided in a feedback configuration between its output and the inverting input node.

15. The circuit as claimed in claim 14 wherein the value of the resistor may be trimmed.

16. The circuit as claimed in claim 12 wherein the current source is of a type that provides an output having a $T/T_0-1$ relationship with temperature; wherein T is an actual temperature and $T_0$ is a reference temperature.

17. The circuit as claimed in claim 1 wherein the second set of circuit elements includes a bipolar transistor.

18. The circuit as claimed in claim 17 where in the bipolar transistor is provided in a forwarded biased configuration.

19. The circuit as claimed in claim 17 wherein the bipolar transistor is coupled to a non-inverting input node of an amplifier.

20. The circuit as claimed in claim 19 wherein the non-inverting input node is additionally coupled to a current source, the current source provided a PTAT current.

21. The circuit as claimed in claim 20 wherein the current source is an adjustable current source which can be used to force the emitter of the transistor to a predetermined voltage value.

22. The circuit as claimed in claim 21 wherein an adjustment of the value of the PTAT current source coupled to the non-inverting node allows for an adjustment of the absolute value of the voltage reference.

23. The circuit as claimed in claim 1 wherein:

the first set of circuit elements includes at least one bipolar transistor coupled to a non-inverting node of an amplifier, the base emitter voltage of the bipolar transistor providing the CTAT voltage;

the second set of circuit elements includes a current source of a type that provides an output having a $T/T_0-1$ relationship with temperature wherein T is an actual temperature and $T_0$ is a reference temperature, the current source being coupled to the inverting node of the amplifier and generating across a resistor provided in a feedback loop to that amplifier a corresponding voltage; and the third set of circuit elements includes the amplifier which couples the CTAT voltage generated by the first set of circuit elements with the PTAT voltage generated by the second set of circuit elements to provide at its output the voltage reference.

24. The circuit as claimed in claim 23 wherein the first set of circuit elements includes a plurality of transistors arranged in a stack configuration.

25. The circuit as claimed in claim 23 wherein the third set of circuit elements includes a bipolar transistor coupled to the output of the amplifier, the emitter of the bipolar transistor providing the voltage reference.

26. The circuit as claimed in claim 23 wherein the output of the amplifier provides an input for a buffer circuit, the buffer circuit providing at its output a buffered voltage reference.

27. The circuit as claimed in claim 26 wherein the buffer circuit includes a second amplifier whose non-inverting input is coupled to the output of the third set of circuit elements.

28. The circuit as claimed in claim 27 wherein an inverting node of the second amplifier is coupled to a scalable resistor provided in a feedback configuration, the scaling of the resistor allowing for a scaling of the buffered voltage reference.

29. A bandgap voltage reference circuit including:

an amplifier, the amplifier having an inverting and non-inverting input and providing at its output a voltage reference;

a bipolar transistor coupled to the non-inverting node of the amplifier, the base emitter voltage of the bipolar transistor generating a CTAT voltage;

a first current source of the type having an output with a $T/T_0-1$ relationship with temperature wherein T is an actual temperature and $T_0$ is a reference temperature, the first current source being coupled to the inverting node of the amplifier, a resistor provided in feedback configuration between the output of the amplifier and its inverting input; and wherein the first current source generates a PTAT voltage across the resistor, the PTAT voltage having a negative value (relative to zero) below a determinable temperature and a positive value (relative to zero) above that temperature, the amplifier combining the CTAT voltage generated by the transistor with the PTAT voltage to define the voltage reference.

30. The circuit as claimed in claim 29 wherein the determinable temperature chosen is such that at normal operating conditions of the circuit, the absolute value of the contribution of the PTAT voltage is zero.

31. The circuit as claimed in claim 29 including a second PTAT current source, the second PTAT current source being coupled to the non-inverting node of the amplifier, the second PTAT current source providing a variable output whose value is selected to scale the value of the voltage reference.

32. The circuit as claimed in claim 31 wherein the second PTAT current source provides the variable output which is used to force the emitter of the transistor to a predetermined value.

33. The circuit as claimed in claim 29 including first and second switches, the first switch being coupled between the $T/T_0-1$ current source and the inverting node of the amplifier and the second switch being provided in the feedback configuration so as to enable a shorting of the resistor.

34. The circuit as claimed in claim 33 wherein the circuit is operational in a first mode where the first switch is closed and the second switch is open and operational in a second mode where the first switch is open and the second switch is closed.

35. The circuit as claimed in claim 34 wherein the first mode is the normal operational mode of the circuit.

36. The circuit as claimed in claim 35 wherein in the first mode the output voltage of the amplifier is equal to the voltage drop across the transistor plus the feedback voltage drop across the feedback resistor due to the current arising from the $T/T_0-1$ current source.

37. The circuit as claimed in claim 36 wherein the value of the feedback resistor may be varied so as to provide for a compensation of the temperature slope of the transistor by the voltage drop across the feedback resistor.

38. The circuit as claimed in claim 34 wherein at a determinable temperature, the voltage output of the amplifier may be trimmed using two steps:

in the second operational mode, the output value of the amplifier may be measured, the measured value being the reference value output, if this reference value output is not the desired value the second PTAT current source may be varied until the desired value is achieved, if this reference value is the desired value output, then the circuit is arranged in the first operational mode wherein the $T/T_0-1$ current source is trimmed until the desired value is once again realised.

39. A bandgap voltage reference including:

a first set of circuit components, the first set of circuit components providing at an output thereof a sub-bandgap voltage reference, the output of the first set of circuit components providing an input for a second set of circuit components, the second set of circuit components providing at an output thereof a buffered reference voltage, the buffered reference voltage being an amplified version of the sub-bandgap voltage reference, and wherein the first set of circuit components include:

a first set of circuit elements, the first set of circuit elements arranged to provide a complementary to absolute temperature (CTAT) voltage or current, a second set of circuit elements, the second set of circuit elements arranged to provide a proportional to absolute temperature (PTAT) voltage or current, such that at absolute zero temperature its polarity (relative to zero) is opposite to that of the complementary to absolute temperature voltage or current produced by the first set of circuit elements, and a third set of circuit elements, the third set of circuit elements being arranged to combine the CTAT voltage or current with the PTAT voltage or current so as to generate the sub-bandgap voltage reference.

40. A bandgap voltage reference circuit configured to provide a voltage reference at an output thereof, the circuit including:

a first set of circuit elements, the first set of circuit elements arranged to provide a shifted proportional to absolute temperature (PTAT) voltage, the shifted PTAT voltage having a crossover point where its polarity (relative to zero) changes from a negative value to a positive value, a second set of circuit elements, the second set of circuit elements arranged to provide a complimentary to absolute temperature (CTAT) voltage, and a third set of circuit elements, the third set of circuit elements being arranged to combine the CTAT voltage with the shifted PTAT voltage so as to generate a voltage reference of the value of CTAT voltage at a specific temperature.

41. The circuit of claim 40 wherein the crossover point is related to a temperature.

42. The circuit of claim 40 wherein the output is a sub-bandgap voltage reference.

43. A bandgap reference circuit configured to provide as an output a sub-bandgap voltage, the circuit including first and second bipolar transistors arranged in a bandgap configuration and being coupled via first and second legs of an amplifier respectively to a non-inverting node and inverting node of the amplifier, the second transistor coupled via a first resistor to the inverting node of the amplifier, the amplifier including a negative feedback path having provided therein a scalable resistor, and wherein the circuit is arranged such that at a first temperature a scaled value of a base emitter voltage generated by the first transistor is used to define an output of the circuit, this defined output being maintained as the output of the amplifier by providing an adjustable $T/T_0-1$ component at the second leg so as to minimise the effect of the second leg contribution to the output and enabling an adjustment of the scalable resistor at a second temperature to provide the sub-bandgap voltage; wherein T is an actual temperature and $T_0$ is a reference temperature.

44. A method of providing a bandgap voltage reference the method comprising:

providing a first set of circuit elements, the first set of circuit elements arranged to provide a complementary to absolute temperature (CTAT) voltage or current;

providing a second set of circuit elements, the second set of circuit elements arranged to provide a proportional to absolute temperature (PTAT) voltage or current, such that at absolute zero temperature its polarity (relative to zero) is opposite to that of the complementary to absolute temperature voltage or current produced by the first set of circuit elements;

adjusting the second set of circuit elements such that the absolute value of the contribution of the PTAT voltage is zero, the second set of circuit elements providing an output that removes any slope effects from the output of the first set of circuit elements; and providing a third set of circuit elements, the third set of circuit elements being arranged to combine the CTAT voltage or current with the PTAT voltage or current so as to generate the voltage reference.

* * * * *